US009771930B2

(12) United States Patent
Görlich

(10) Patent No.: US 9,771,930 B2
(45) Date of Patent: Sep. 26, 2017

(54) COMPRESSOR UNIT, AND COMPRESSOR

(71) Applicant: GEA BOCK GMBH, Frickenhausen (DE)

(72) Inventor: Arno Görlich, Neuffen (DE)

(73) Assignee: GEA BOCK GMBH (DE)

( * ) Notice: Subject to any disclaimer, the term of this patent is extended or adjusted under 35 U.S.C. 154(b) by 264 days.

(21) Appl. No.: 14/386,468

(22) PCT Filed: Mar. 19, 2013

(86) PCT No.: PCT/EP2013/000830
§ 371 (c)(1),
(2) Date: Sep. 19, 2014

(87) PCT Pub. No.: WO2013/139468
PCT Pub. Date: Sep. 26, 2013

(65) Prior Publication Data

US 2015/0044072 A1 Feb. 12, 2015

(30) Foreign Application Priority Data

Mar. 19, 2012 (DE) ..... 10 2012 005 297

(51) Int. Cl.
*F04B 27/053* (2006.01)
*F04B 27/04* (2006.01)
(Continued)

(52) U.S. Cl.
CPC ..... *F04B 27/053* (2013.01); *F04B 9/045* (2013.01); *F04B 17/03* (2013.01);
(Continued)

(58) Field of Classification Search
CPC ..... F04B 27/053; F04B 27/0415; F04B 27/0428; F04B 27/0442; F04B 27/109;
(Continued)

(56) References Cited

U.S. PATENT DOCUMENTS

| | | | | |
|---|---|---|---|---|
| 4,339,988 | A * | 7/1982 | Steele | F01B 1/062 91/493 |
| 5,280,745 | A * | 1/1994 | Maruno | F04B 9/045 417/221 |
| 5,415,078 | A * | 5/1995 | Beveridge | F02B 33/04 123/73 A |
| 2005/0120984 | A1* | 6/2005 | Kuhn | F04B 1/053 123/54.5 |
| 2009/0178433 | A1* | 7/2009 | Kumakura | F01C 1/322 62/402 |
| 2010/0092313 | A1 | 4/2010 | Suss et al. | |

FOREIGN PATENT DOCUMENTS

| | | |
|---|---|---|
| DE | 64 769 A5 | 11/1968 |
| DE | 10 2005 047 284 | 4/2007 |

(Continued)

OTHER PUBLICATIONS

International Search Report dated May 27, 2013 issued in corresponding International patent application No. PCT/EP2013/000830.

(Continued)

*Primary Examiner* — Devon Kramer
*Assistant Examiner* — Christopher Brunjes
(74) *Attorney, Agent, or Firm* — Ostrolenk Faber LLP

(57) ABSTRACT

Compressor unit (12) of a compressor (10) for compressing refrigerant, comprising a drive device, particularly a drive shaft (24), for driving one or more pistons (14) that are arranged in a radial direction and that can be moved back and forth in extension and retraction movements in corresponding cylinder bores (16), wherein the drive device is in operative engagement with an eccentric (28) that controls the extension movement of the pistons (14), said eccentric (28) also controlling the retraction movement of the piston (14), the invention further relating to a corresponding compressor (10).

19 Claims, 2 Drawing Sheets

(51) Int. Cl.
*F04B 17/03* (2006.01)
*F04B 9/04* (2006.01)

(52) U.S. Cl.
CPC ..... *F04B 27/0414* (2013.01); *F04B 27/0428* (2013.01); *F04B 27/0442* (2013.01)

(58) Field of Classification Search
CPC ..... F04B 27/1063; F04B 9/045; F04B 17/03; F04B 35/045; F04B 1/0404; F04B 1/0408; F04B 1/0413; F04B 1/053; F04B 1/0421
See application file for complete search history.

(56) References Cited

FOREIGN PATENT DOCUMENTS

| | | | | |
|---|---|---|---|---|
| DE | 10 2008 025 323 | | 12/2009 | |
| EP | 1 553 291 | B1 | 7/2005 | |
| FR | 538037 | | 6/1922 | |
| FR | WO 2012107480 | A1 * | 8/2012 | ..... F04B 25/00 |
| GB | 177 225 | | 3/1922 | |
| GB | 1122348 | | 8/1968 | |
| WO | WO 2007/036972 | A1 | 4/2007 | |

OTHER PUBLICATIONS

Written Opinion dated May 27, 2013 issued in corresponding International patent application No. PCT/EP2013/000830.
German Search Report dated Mar. 4, 2013 issued in corresponding German patent application No. 10 2012 005 297.9.

* cited by examiner

COMPRESSOR UNIT, AND COMPRESSOR

CROSS REFERENCE TO RELATED APPLICATIONS

The present application is a 35 U.S.C. §371 National Phase conversion of PCT/EP2013/005379, filed Mar. 19, 2013, which claims benefit of German Application No. 10 2012 005 297.9, filed Mar. 19, 2012, the disclosure of which is incorporated herein by reference. The PCT International Application was published in the German language.

TECHNICAL FIELD OF THE INVENTION

The present invention relates to a compressor unit for a compressor for compressing in particular refrigerant according to the preamble of claim 1, as well as a corresponding compressor, in particular a radial piston compressor, according to the preamble of claim 12.

BACKGROUND OF THE INVENTION

Given the global trade in goods that has developed which increasingly includes goods that require cooling during transport, and given the increasing requirements of people for comfort, the need for cooling systems is continuously increasing and hence in particular the need for compressor units and compressors that supply the cold for the aforementioned cooling systems. In times in which energy resources are expensive and not least because minimal energy consumption is desirable due to environmental policy considerations, efforts are underway to design refrigerant compressors as small as possible, as simple as possible, and weighing as little as possible. Furthermore, a goal is to design corresponding compressors for use with environmentally-friendly refrigerants such as $CO_2$ as the refrigerant (refrigerant R744) in order to thereby restrict use of fluorocarbon-containing refrigerants.

A radial piston compressor which is designed for $CO_2$ as the refrigerant is for example known from EP 1 552 291 B1 which discloses a reciprocating engine in the form of a radial piston compressor with a compressor unit having annular, radially aligned piston cylinder units arranged next to each other, and with an eccentric shaft. The eccentric shaft extends through a housing body of a machine housing which encloses the cylinders, and the eccentric thereof controls the outward stroke of the pistons. The inward stroke of the pistons is controlled or respectively instigated by a common control ring engaging in the pistons. The control ring is engaged in a lateral recess in each piston, running in the direction of a secant, and being adapted to a cross-sectional shape of the control ring, and bordering a floor wall of the piston, wherein the control ring is in controlling sliding contact with this floor wall by means of an inner control surface.

This design of a radial piston compressor according to EP 1 553 291 B1 is relatively complicated. Furthermore, the polygonal (hexagonal) return ring according to EP 1 553 291 B1 for the return movement of the pistons slides within the piston grooves perpendicular to the direction of traction. In addition to limiting the available or respectively useful return forces, this also results in a tendency of the ring to tilt. The above-described construction also constitutes an arrangement that provides a "one-sided" engagement by the return ring in the piston grooves and hence one-sided material stresses. In particular with multistage compressors in which high return forces are required, a return mechanism is also required that can withstand the corresponding forces.

Based on the above-discussed preceding art, it is therefore the object of the present invention to present a compressor unit of a compressor for compressing refrigerant which, in comparison to the compressor units according to the preceding art, is universally useable, relatively easy to design and hence also economical to manufacture. Furthermore, it is the object of the present invention to present a corresponding compressor.

SUMMARY OF THE INVENTION

This object is solved according to the invention by a compressor unit according to claim 1. The aspect of the task relating to a compressor is achieved by a compressor according to claim 12.

According to the invention, a corresponding compressor unit that is provided for compressing refrigerant has a drive device in the form of a drive shaft that is provided to drive one or more pistons arranged in a radial direction. The pistons can move back-and-forth in corresponding cylinder bores in extension and retraction movements. The extension movements occur in the direction directed radially outward, whereas the refraction movements signify a movement of the pistons toward the radial center. The cylinder bores are also arranged in the radial direction, in particular with a cylinder bore midaxis that is arranged in the radial direction. The drive device (drive shaft) is in operative engagement with an eccentric which controls the extension movement of the pistons, i.e., the pistons move in a direction that is directed radially outward in any manner by means of its corresponding eccentric movement (extension movement). The eccentric can optionally be designed integral with the drive shaft and/or as a component thereof. Furthermore, the eccentric also controls the retraction movement of the pistons according to the invention, which means that the eccentric is also responsible for a "retraction" of the pistons toward the radial center. That is, the corresponding eccentric movement of the eccentric moves the pistons in any manner in a direction directed radially inward, or respectively is causally responsible for the movement directed radially inward, as it is also responsible for the movement directed outward.

Stated otherwise, a compressor unit of a compressor for compressing refrigerant with a drive device, particularly a drive shaft, for driving one or more pistons that are arranged in a radial direction and that can be moved back and forth in extension and retraction movements in corresponding cylinder bores has a device for executing a extension movement of the pistons, and a device for executing the retraction movement of the pistons, which are both controlled or respectively driven by the eccentric. In a simply designed embodiment, the device for executing a extension movement of the pistons is identical with the device for executing the retraction movement of the pistons. In this case, e.g. a connection between a respective piston and the eccentric would be conceivable, for example by means of, in particular, a rigid connection that e.g. can be realized in the form of a connecting rod, and that completely transmits the movement of the eccentric to the piston.

In comparison to the preceding art, this constitutes a simplified and, in particular, robust and hence less error-prone solution to a compressor unit and also a corresponding compressor.

The eccentric of the compressor unit preferably has an operative eccentric section, by means of which it is in operative engagement with one or more connecting rods, in particular operative connecting rod sections of the respective connecting rods.

The operative eccentric section preferably has a circular cross-section, and the operative connecting rod cross-sections are preferably shaped as a circular segment corresponding thereto on their side facing the operative eccentric section. In one possible embodiment, a bearing, in particular a needle bearing, is arranged between the operative connecting rod section and the operative eccentric section which ensures a very low-friction and hence low-energy-loss drive of the connecting rods and the pistons operatively engaged thereto.

In one simply designed embodiment, the operative connecting rod sections are arranged on a circular path around the operative eccentric section. This embodiment is in particular also suitable for the aforementioned arrangement of a bearing, in particular a needle bearing, between the two operative sections.

In regard to the aspect of the task of the present invention relating to a compressor, reference is made to claim 12 in which a corresponding compressor is presented, wherein additional possible embodiments are described in the claims dependent thereupon. The compressor has the advantages and features that were already described in association with the compressor unit solving the task according to the invention.

At this juncture, the difference between the compressor unit and compressor will be addressed. In a simple form, the device identified as the compressor unit in the present application can constitute a compressor. This would for example be the case with an open compressor that delivers drive from an external drive source for the drive device, such as a drive shaft of the compressor unit. Since when a compressor is mentioned, also a corresponding motor and possibly hermetically sealed housing components etc. are frequently associated with the compressor, a distinction is made for the sake of illustration in the context of the present application between a compressor that, in the simplest embodiment, can be identical to the compressor unit but which can have additional components, and a compressor unit that exclusively serves to compress a fluid, in particular a refrigerant, especially a gaseous refrigerant.

BRIEF DESCRIPTION OF THE DRAWINGS

Additional features of the invention are presented in the dependent claims.

The invention will be described in the following with reference to the accompanying drawings using exemplary embodiments. The drawings show:

FIG. 1 shows a sectional view of a compressor 10 according to the invention, wherein the section is in the region of a compressor unit 12 of the compressor 10 according to the invention perpendicular to an axial direction.

DESCRIPTION OF PREFERRED EMBODIMENTS

Figure 1:
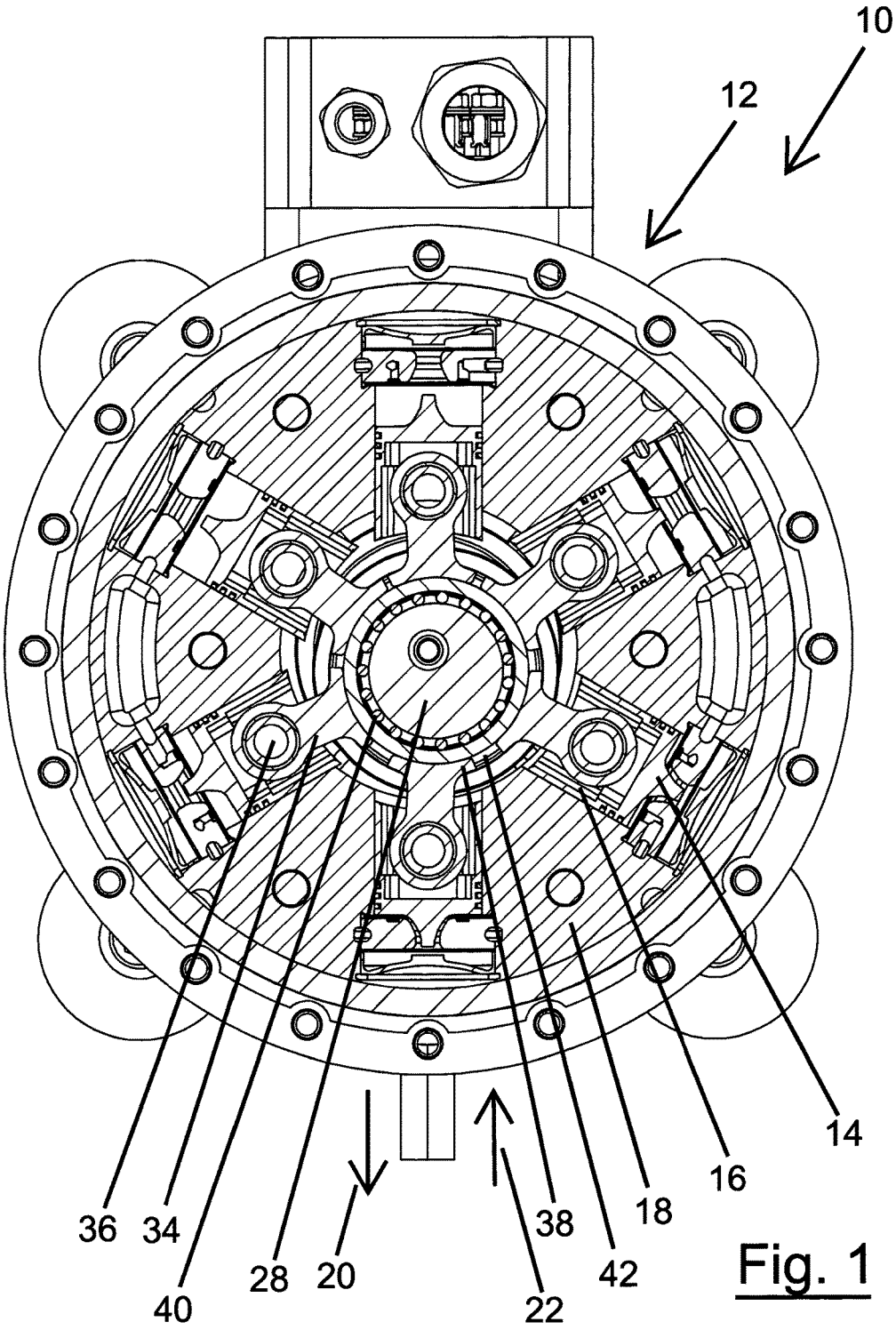
FIG. 1 A sectional view of an embodiment of a compressor according to the invention in a section perpendicular to the axial direction.

As can be seen in FIG. 1, a compressor unit 12 according to the invention has six pistons 14 that can be moved back and forth in a radial direction and are arranged in corresponding cylinder bores or cylinder linings 16. The cylinder bores or respectively cylinder linings 16 themselves are designed as corresponding recesses in a cylinder block 18. As mentioned above, the pistons 14 are designed such that they can move back and forth in the radial direction. In regard to this back-and-forth movement, a distinction is made below between an extension movement and a retraction movement, wherein the extension movement is directed in the radial direction toward the outside (illustrated by arrow 20), and the retraction movement is directed in a radial direction toward the inside (illustrated by arrow 22). The compressor unit 12 serves to compress refrigerant wherein, in the embodiments described herein and shown in the figures, R744 ($CO_2$) preferably is the refrigerant. It should however be noted that use of any other refrigerant (such as R134a, etc.) is conceivable. Stated otherwise, the subject matter of the present invention is a refrigerant compressor for compressing refrigerant, in particular $CO_2$. It is a compressor that in particular is provided for compressing gaseous media, i.e., a compressor for compressing gaseous refrigerant.

Figure 2:
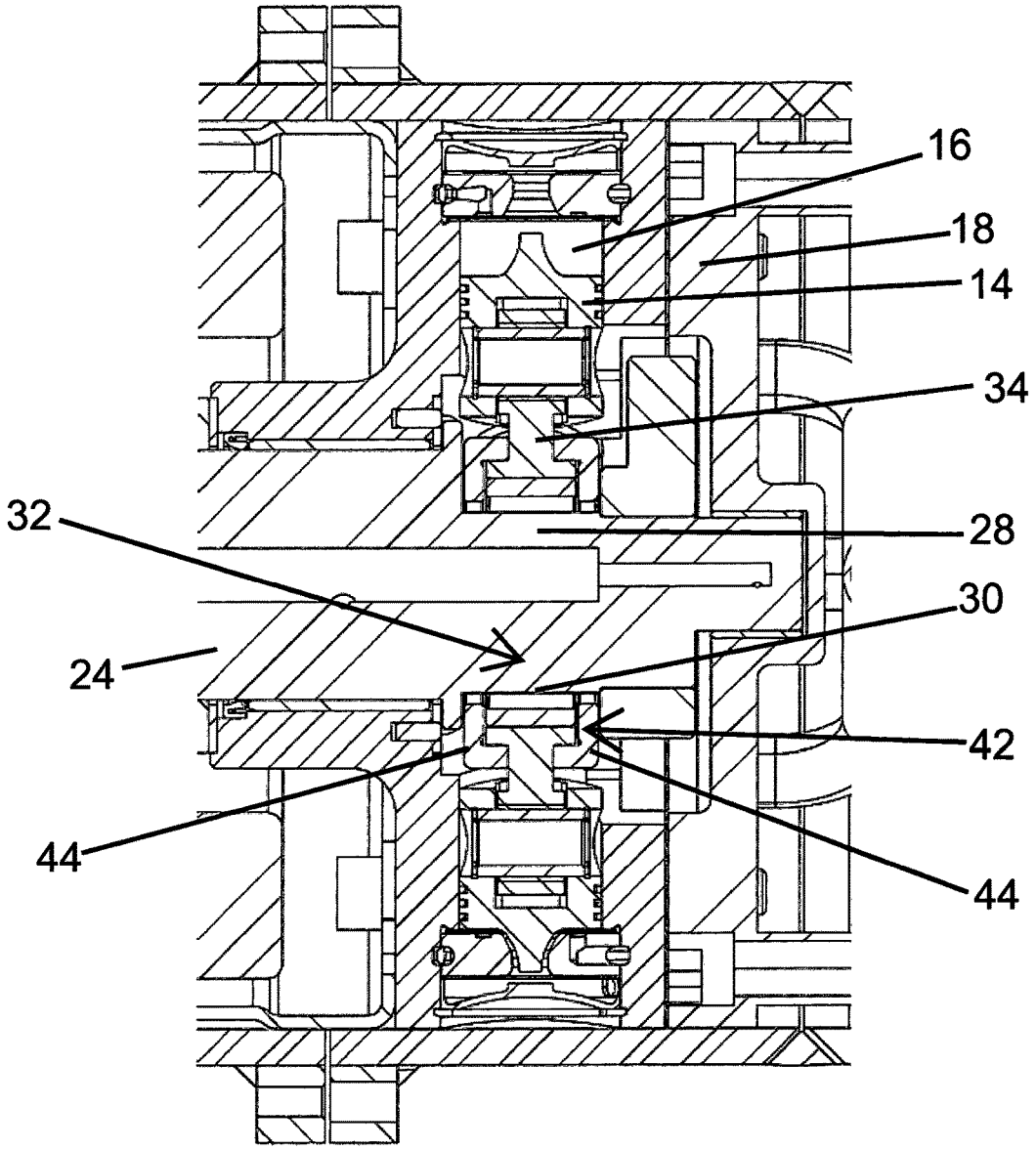
FIG. 2 Another sectional representation of a compressor according to the invention in a section parallel to the axial direction.

Furthermore, the compressor unit 12 according to the invention has a drive device in the form of a drive shaft 24 (see for example FIG. 2), by means of which the compressor unit 12 can be driven. In the described embodiment of a compressor 10 according to the invention, the drive shaft is coupled to an electric motor (not shown), but can however also be coupled to a corresponding belt drive device or other device in an alternative embodiment. At this juncture, it is noted that the axial extension of the drive shaft 24, depending on the intended use, can also be shorter than the embodiment shown in the figures in which the drive shaft 24 is in operative engagement with the electric motor and extends through the electric motor.

In the context of the extension and refraction movements of the pistons, the refrigerant is drawn into the cylinder bores or respectively cylinder liners 16 during a refraction movement of the pistons, is compressed upon execution of the extension movement, and is then ejected.

The drive device in the form of the drive shaft 24 is in operative engagement with an eccentric 28. More precisely, the drive shaft 24 is designed eccentrically in a corresponding region (eccentric section of the drive shaft 24). The eccentric 28 is hence designed to be integral and a single piece with, and on, the drive shaft 24. In alternative embodiments, the eccentric 28 can also be designed as a separate component and attached to the drive shaft 24, in particular articulated or correspondingly mounted.

In a section perpendicular to the axial direction, the eccentric 28 has a circular cross-section and eccentric surfaces 30 directed radially outward that are arranged in a region of an operative eccentric section 32. The operative eccentric section 32 serves to drive the pistons 14 and is in operative engagement with them by means of a connecting rod 34 assigned to each piston 14. For this, the connecting rods 34 are articulated to the pistons 14 by means of connecting rod eyes 36 that are formed on the sides of the connecting rods 34 facing the pistons 14.

On the side facing the eccentric 28, the connecting rods 34 have an operative connecting rod section 38 that serves to operatively engage the eccentric 28. The eccentric 28 is in operative engagement with the operative connecting rod sections 38 by means of a bearing in the form of a needle bearing 40 that is arranged on the eccentric operating section 32 (circular cross-section) where it is arranged on the eccentric surface 30 (fitted). Alternatively to the needle bearing 40, other bearings are conceivable, in particular slide bearings or roller bearings in any possible design.

The bearing 40 ensures a low friction transfer and conversion of the movement (rotary movement) of the eccentric 28 in a movement directed in a radial direction of an effective connecting rod section seat 42 that is in operative engagement with the bearing by means of a corresponding fit. The corresponding movement in a radial direction is then correspondingly transferred to the connecting rods 34 and the pistons 14 articulated thereto. The operative connecting rod sections 38 that are designed to correspond with the circular outer perimeter of the bearing 40 and are shaped as a circular segment on their side facing the bearing 40 have an extension that widens in an axial direction at their end facing the bearing such that they are securely arranged on the bearing 40 in two shells 44 designed with an L-shaped cross-section and that form the operative connecting rod section seat 42. The operative connecting rod sections of all connecting rods 34 are arranged on a circular path around the eccentric 28 and hence also around the operative eccentric section 32 that is concentric therewith.

Because the pendulum point of the device is arranged eccentrically due to the use of the eccentric, the present construction in which circular-segment-like operative connecting rod sections are used and the movements of the connecting rods can be disengaged from each other, a different movement can occur in each case in the region of the respective pistons. If the connecting rods were rigidly coupled, a fault would arise in the stroke movement and hence increase the dead space in the region of the pistons distant from the pendulum point.

In one possible embodiment, as mentioned above, the compressor unit 12 and hence the compressor 10 are a compressor unit 12 or respectively compressor 10 which is designed as a refrigerant compressor that has $CO_2$ as a refrigerant, or for which $CO_2$ is used as the refrigerant. In this compressor unit 12, the ratio of the stroke of a cylinder to the diameter of its bore is 0.3 to 1, in particular 0.3 to 0.7, and more particularly 0.35 to 0.5 and more particularly 0.4. In other words, the value of the stroke/bore ratio is 0.3 to 1, in particular 0.3 to 0.7, more particularly 0.35 to 0.5 and more particularly 0.4. These are the applicable stroke/bore ratios for the described possible embodiment, wherein a value from an interval from 0.3 to 1 can be selected depending on the design requirements. The other cited values with decreasing intervals are values that are preferred in terms of energy if they are feasible within the given design parameters.

The compressor unit according to the invention has 3 to 8 pistons in possible embodiments, in particular 4 to 6 pistons. Particularly for $CO_2$ compressors, more particularly for $CO_2$ compressors of a small design, this is a favourable number of pistons for the design.

It should be noted that the above-described embodiment of the compressor 10 has the electric motor 26 for driving the compressor unit 12, wherein the electric motor 26 is in operative engagement with the drive shaft 24 of the compressor unit 12, or respectively drives it. The compressor 10 of the described embodiment is a hermetically designed compressor, wherein it is noted that the concept according to the invention is of course applicable to open, semi-hermetic, hermetic and other compressors with a different design. The compressor does not have to be driven by an electric motor and can also be designed as a belt drive or another drive option that may be integrated in the compressor, or is also located outside of the compressor.

Although the invention is described with reference to embodiments having fixed combinations of features, it also comprises conceivable, further advantageous combinations as are in particular, but not exhaustively, presented in the dependent claims. All of the features disclosed in the application documents are claimed as essential to the invention to the extent that they are novel over the preceding art by themselves or in combination.

LIST OF REFERENCE NUMBERS

10 Compressor
12 Compressor unit
14 Piston
16 Cylinder bores/cylinder linings
18 Cylinder block
20 Arrow
22 Arrow
24 Drive shaft
28 Eccentric
30 Operative eccentric surface
32 Operative eccentric section
34 Connecting rod
36 Connecting rod eye
38 Operative connecting rod section
40 Needle bearing
42 Operative connecting rod section seat
44 Shell

What is claimed is:

1. A compressor unit of a compressor for compressing refrigerant, the compressor unit comprising:

a drive device that drives one or more pistons arranged in a radial direction and configured to move back and forth in extension and retraction movements in corresponding cylinder bores, and an eccentric in operative engagement with the drive device to control the extension and the retraction movement of the pistons, the eccentric having an operative eccentric section with a bearing having a circular outer perimeter and in operative engagement with one or more operative connecting rod sections of respective connecting rods, wherein the operative connecting rod sections are arranged on the bearing by an operative connecting rod section seat, whereby the movements of the connecting rods can be disengaged from each other and wherein the operative connecting rod sections are designed to correspond with the circular outer perimeter of the bearing and are shaped as a circular segment on their side facing the bearing and have an extension that widens in an axial direction at their end facing the bearing such that they are securely arranged on the bearing in two shells designed with an L-shaped cross-section and that form the operative connecting rod section seat.

2. The compressor unit according to claim 1, wherein the compressor unit has for each piston the respectively connecting rod that is articulated thereto by means of a connecting rod eye which is formed on the side of the connecting rod facing the respective piston.

3. The compressor unit according to claim 1, wherein the compressor unit has for each piston the respectively connecting rod that is in operative engagement with the eccentric by means of the operative connecting rod section that is formed on the side of the connecting rod facing the operative eccentric section.

4. The compressor unit according to claim 1, wherein the operative eccentric section has a circular cross-section, and/or in that the sides of the connecting rod facing the operative eccentric section are shaped as a circular segment.

5. The compressor unit according to claim 1, wherein the operative connecting rod sections are arranged concentrically on a circular path around the eccentric.

6. The compressor unit according to claim 5, wherein the bearing is arranged between the operative connecting rod section and the operative eccentric section.

7. The compressor unit according to claim 6, wherein the bearing is a needle bearing.

8. The compressor unit according to claim 1, wherein the compressor unit (12) has $CO_2$ as a refrigerant.

9. The compressor unit according to claim 1, wherein the compressor unit has a stroke/bore ratio of 0.3 to 1.

10. The compressor unit according to claim 1, wherein the compressor unit has a stroke/bore ratio of 0.35 to 0.5.

11. The compressor unit according to claim 1, wherein the compressor unit has 3 to 8 pistons.

12. The compressor according to claim 1, wherein the drive device is a drive shaft.

13. The compressor unit according to claim 1, wherein the compressor unit has a stroke/bore ratio of 0.3 to 0.7.

14. The compressor unit according to claim 1, wherein the compressor unit has a stroke/bore ratio of 0.4.

15. The compressor unit according to claim 1, wherein the compressor unit has 4 to 6 pistons.

16. A compressor for compressing refrigerant wherein the compressor has a compressor unit according to claim 1.

17. The compressor according to claim 16, wherein the compressor has an electric motor for driving the compressor unit, wherein the electric motor is in operative engagement with the drive device, in particular the drive shaft, of the compressor unit.

18. The compressor according to claim 16, wherein the compressor is a hermetically designed compressor.

19. A compressor unit of a compressor for compressing refrigerant comprising a drive device for driving one or more pistons that are arranged in a radial direction and that can be moved back and forth in extension and retraction movements in corresponding cylinder bores, wherein the drive device is in operative engagement with an eccentric that controls the extension movement of the pistons, wherein the eccentric also controls the retraction movement of the pistons, the eccentric having an operative eccentric section with a bearing having a circular outer perimeter and in operative engagement with one or more operative connecting rod sections of respective connecting rods, wherein the operative connecting rod sections are designed to correspond with the circular outer perimeter of the bearing and are shaped as a circular segment on their side facing the bearing and have an extension that widens in an axial direction at their end facing the bearing such that they are securely arranged on the bearing in two shells designed with an L-shaped cross-section to form an operative connecting rod section seat.

* * * * *